US006783228B2

(12) United States Patent
Szumla et al.

(10) Patent No.: US 6,783,228 B2
(45) Date of Patent: Aug. 31, 2004

(54) DIGITAL OFFSET LITHOGRAPHIC PRINTING

(75) Inventors: Thomas P. Szumla, Lockport, NY (US); David A. Niemeyer, Rochester, NY (US); Charles D. DeBoer, Palmyra, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/335,383

(22) Filed: Dec. 31, 2002

(65) Prior Publication Data

US 2004/0125188 A1 Jul. 1, 2004

(51) Int. Cl.[7] ..... B41J 2/01; B41M 5/00
(52) U.S. Cl. ..... 347/103; 347/101; 101/466
(58) Field of Search ..... 347/101, 103, 347/102, 100; 101/466, 465, 455

(56) References Cited

U.S. PATENT DOCUMENTS

| | | | | |
|---|---|---|---|---|
| 3,832,948 A | | 9/1974 | Barker | |
| 4,034,183 A | | 7/1977 | Uhlig | |
| 4,054,094 A | | 10/1977 | Caddell et al. | |
| 4,081,572 A | | 3/1978 | Pacansky | |
| 4,731,317 A | | 3/1988 | Fromson et al. | |
| 5,372,907 A | | 12/1994 | Haley et al. | |
| 5,460,918 A | | 10/1995 | Ali et al. | |
| 5,820,932 A | | 10/1998 | Hallman et al. | |
| 6,044,762 A | | 4/2000 | DeBoer et al. | |
| 6,050,193 A | | 4/2000 | DeBoer et al. | |
| 6,486,903 B1 | * | 11/2002 | Wagner et al. | 347/212 |
| 6,569,349 B1 | * | 5/2003 | Wang et al. | 252/79.1 |
| 6,610,458 B2 | * | 8/2003 | Miller et al. | 101/465 |
| 2003/0159607 A1 | * | 8/2003 | Nitzan et al. | 101/466 |

FOREIGN PATENT DOCUMENTS

| | | |
|---|---|---|
| CA | 2107980 | 10/1993 |
| EP | 0503621 | 3/1992 |
| EP | 0562952 | 12/1996 |
| JP | 55-105560 | 8/1980 |
| WO | WO 92/09934 | 6/1992 |

* cited by examiner

*Primary Examiner*—Stephen D. Meier
*Assistant Examiner*—Manish Shah
(74) *Attorney, Agent, or Firm*—Raymond L. Owens; J. Lanny Tucker

(57) ABSTRACT

An apparatus for offset lithographic printing including an offset lithographic printing press including a printing cylinder having a surface including a mixture of cationic colloidal silica, fumed alumina, and a polymeric amine; and an inkjet printhead disposed to print a digital image on the printing cylinder with an ink jet fluid including a pigment and a polymeric dispersing agent, which ink jet fluid dries to produce a surface active to oleophilic lithographic printing inks.

8 Claims, 1 Drawing Sheet

DIGITAL OFFSET LITHOGRAPHIC PRINTING

CROSS REFERENCE TO RELATED APPLICATION

Reference is made to commonly-assigned U.S. patent application Ser. No. 10/335,415 filed concurrently herewith, entitled "Inkjet Lithographic Printing Plates" by Szumla et al, the disclosure of which is incorporated herein by reference.

FIELD OF THE INVENTION

This invention relates to offset lithographic printing.

BACKGROUND OF THE INVENTION

The art of lithographic printing is based upon the immiscibility of oil and water, wherein the image area preferentially retains the oily material or ink. When a suitably prepared surface is moistened with water and ink is then applied, the background or non-image area retains the water and repels the ink while the image area accepts the ink and repels the water. The ink on the image area is then transferred to the surface of a material upon which the image is to be reproduced; such as paper, cloth and the like. Commonly the ink is transferred to an intermediate material called the blanket which in turn transfers the ink to the surface of the material upon which the image is to be reproduced.

Ordinarily, the printing cylinder of the press is equipped with a printing plate, that carries the image and background of the printed impression. A very widely used type of lithographic printing plate has a light-sensitive coating applied to an aluminum base. The coating may respond to light by having the portion which is exposed become soluble so that it is removed in the developing process. Such a plate is referred to as positive-working. Conversely, when that portion of the coating which is exposed becomes hardened, the plate is referred to as negative-working. In both instances the image area remaining is ink-receptive or oleophilic and the non-image area or background is water-receptive or hydrophilic. The differentiation between image and non-image areas is made in the exposure process where a film is applied to the plate with a vacuum to insure good contact. The plate is then exposed to a light source, a portion of which is composed of UV radiation. In the instance where a positive plate is used, the area on the film that corresponds to the image on the plate is opaque so that no light will strike the plate, whereas the area on the film that corresponds to the non-image area is clear and permits the transmission of light to the coating which then becomes more soluble and is removed. In the case of a negative plate the converse is true. The area on the film corresponding to the image area is clear while the non-image area is opaque. The coating under the clear area of film is hardened by the action of light while the area not struck by light is removed. The light-hardened surface of a negative plate is therefore oleophilic and will accept ink while the non-image area which has had the coating removed through the action of a developer is desensitized and is therefore hydrophilic.

Direct write photothermal litho plates are known as the Kodak Direct Image Thermal Printing Plate manufactured by Kodak Polychrome Graphics. However, they require wet processing in alkaline solutions. It would be desirable to have direct write litho plates that did not require any processing.

The prior art has tried to produce such plates by a variety of means. All of them fall short of a plate that has high writing sensitivity, high image quality, short roll up, and long run length without any processing.

U.S. Pat. No. 5,372,907 describes a direct write litho plate which is exposed to a laser beam, then heated to crosslink and thereby prevent the development of the exposed areas and to simultaneously render the unexposed areas more developable. The plate is then developed in conventional alkaline plate developer solution. The problem with this is that developer solutions and the equipment that contains them require maintenance, cleaning, and periodic developer replenishment, all of which are costly and cumbersome.

U.S. Pat. No. 4,034,183 describes a direct write litho plate without development whereby a laser absorbing hydrophilic top layer coated on a base is exposed to a laser beam to bum the absorber to convert it from an ink repelling to an ink receiving state. All of the examples and teachings require a high power laser, and the run lengths of the resulting litho plates are limited.

U.S. Pat. No. 3,832,948 describes both a printing plate with a hydrophilic layer that may be ablated by strong light from a hydrophobic base and also a printing plate with a hydrophobic layer that may be ablated from a hydrophilic base. However, no examples are given.

U.S. Pat. No. 3,964,389 describes a no process printing plate made by laser transfer of material from a carrier film (donor) to a lithographic surface. The problem of this method is that small particles of dust trapped between the two layers may cause image degradation. Also, two sheets to prepare is more expensive.

U.S. Pat. No. 4,054,094 describes a process for making a litho plate by using a laser beam to etch away a thin top coating of polysilicic acid on a polyester base, thereby rendering the exposed areas receptive to ink. No details of run length or print quality are giving, but it is expected that an uncrosslinked polymer such as polysilicic acid will wear off relatively rapidly and give a short run length of acceptable prints.

U.S. Pat. No. 4,081,572 describes a method for preparing a printing master on a substrate by coating the substrate with a hydrophilic polyamic acid and then imagewise converting the polyamic acid to melanophilic, polyimide with heat from a flash lamp or a laser. No details of run length, image quality or ink/water balance are given.

U.S. Pat. No. 4,731,317 describes a method for making a litho plate by coating a polymeric diazo resin on a grained anodized aluminum litho base, exposing the image areas with a yttrium aluminum garnet (YAG) laser, and then processing the plate with a graphic arts lacquer. The lacquering step is inconvenient and expensive.

Japanese Kokai No. 55/105560 describes a method of preparation of a litho plate by laser beam removal of a hydrophilic layer coated on a oliophilic base, in which a hydrophilic layer contains colloidal silica, colloidal alumina, a carboxylic acid, or a salt of a carboxylic acid. The only examples given use colloidal alumina alone, or zinc acetate alone, with no crosslinkers or addenda. No details are given for the ink/water balance or limiting run length.

WO 92/09934 describes and broadly claim any photosensitive composition containing a photoacid generator and a polymer with acid labile tetrahydropyranyl groups. This would include a hydrophobic/hydrophilic switching lithographic plate composition. However, such a polymeric switch is known to give weak discrimination between ink and water in the printing process.

EP 0 562 952 A1 describes a printing plate having a polymeric azide coated on a lithographic base and removal of the polymeric azide by exposure to a laser beam. No printing press examples are given.

U.S. Pat. No. 5,460,918 describes a thermal transfer process for preparing a litho plate from a donor with an oxazoline polymer to a silicate surface receiver. A two sheet system such as this is subject to image quality problems from dust and the expense of preparing two sheets.

European Patent Publication No. 503,621 discloses a direct lithographic plate making method which includes jetting a photocuring ink onto the plate substrate, and exposing the plate to UV radiation to harden the image area. An oil-based ink may then be adhered to the image area for printing onto a printing medium. However, there is no disclosure of the resolution of ink drops jetted onto the substrate, or the durability of the lithographic printing plate with respect to printing runlength.

Canadian Patent No. 2,107,980 discloses an aqueous ink composition which includes a first polymer containing a cyclic anhydride or derivative thereof and a second polymer that contains hydroxyl sites. The two polymers are thermally crosslinked in a baking step after imaging of a substrate. The resulting matrix is said to be resistant to an acidic fountain solution of an offset printing process. The Examples illustrate production of imaged plates said to be capable of lithographic runlengths of from 35,000 to 65,000 copies, while a non-crosslinked imaged plate exhibited a runlength of only 4,000 copies U.S. Pat. No. 5,364,702 discloses an ink-jet recording layer supported on a substrate, with the ink receiving layer containing at least one of acetylene glycol, ethylene oxide addition product and acetylene glycol and acetylene alcohol, each of which have a triple bond in its molecule. The ink receiving layer may also contain an inorganic pigment such as silica, a water-soluble polymeric binder, and a cationic oligomer or polymer. No discussion of porosity is provided.

U.S. Pat. No. 5,820,932 discloses a process for the production of lithographic printing plates. Ink jet liquid droplets form an image upon the surface of a printing plate corresponding to digital information depicting the image as provided by a computer system which is in communication with the printer heads. The droplets from the printer head comprise resin forming reactants which polymerize on the plate surface, alone or in combination with reactant precoated on the plate, to form a printable hard resin image. The resin image so formed provides a lithographic printing plate useful for extended print runs.

SUMMARY OF THE INVENTION

It is an object of this invention to prepare lithographic printing plates directly on the press from a digital image file stored on a computer, utilizing a commercially available inkjet print heads with commercially available inkjet inks.

It is another object of this invention to provide a means of preparing a lithographic printing plate utilizing an inkjet printer directly on the press.

It is another object of this invention to provide a means of preparing a lithographic printing plate cheaply and economically.

It is another object of this invention to provide a means of preparing a lithographic printing plate producing high quality press impressions.

These objects are achieved by an apparatus for offset lithographic printing comprising an offset lithographic printing press including a printing cylinder having a surface including a mixture of cationic colloidal silica, fumed alumina, and a polymeric amine and, an inkjet printhead disposed to print a digital image on the printing cylinder with a fluid that dries to produce a surface attractive to oleophilic lithographic printing inks.

An advantage of this invention is that the printing plates can be prepared from digital sources with minimal cost and difficulty.

Another advantage of this invention is that the printing plates can be prepared utilizing commercially available inkjet print heads with commercially available inkjet inks.

DETAILED DESCRIPTION OF THE INVENTION

Figure 1:
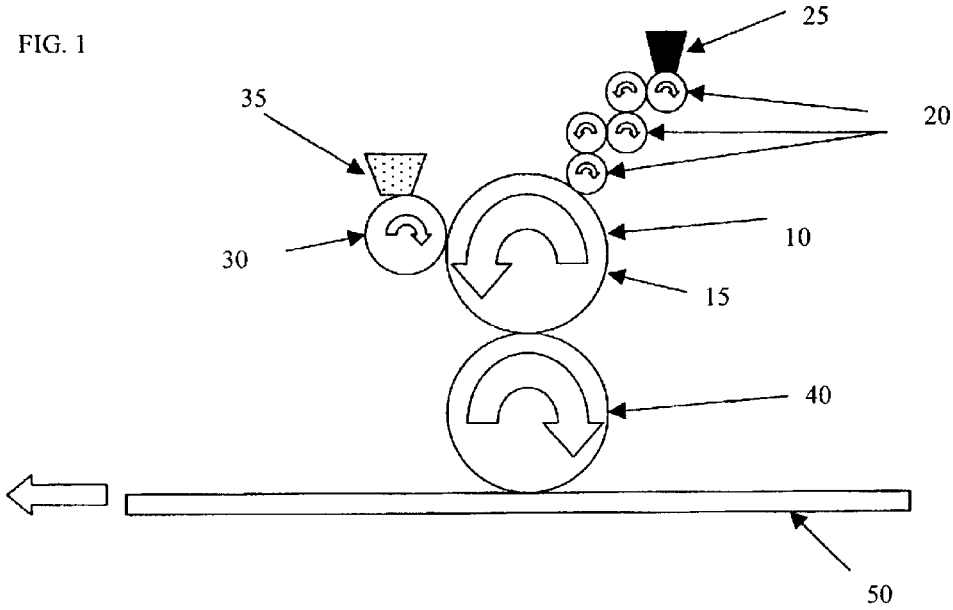
FIG. 1 shows a side view of a lithographic printing press according to this invention.

FIG. 1 shows a side view of the printing press apparatus of this invention. A printing cylinder 10 having a surface 15 includes a mixture of silica, alumina, and a polymeric amine. An ink roller train 20 supplies ink from an ink hopper 25 to the printing cylinder 10, and a dampener roller 30 supplies fountain solution from a fountain solution hopper 35 to the printing cylinder 10. The lithographic ink image is transferred to the blanket cylinder 40, and from there to the paper 50 to complete the printing process.

The printing cylinder 10 of the printing press apparatus can be directly coated with the mixture including silica, alumina and a polymeric amine, or the mixture can be coated onto a printing plate substrate and the printing plate mounted onto the printing cylinder 10. If the support of the printing plate is sufficiently flexible, such as polyethylene terphthalate, a supply roll of the coated printing plate material can be located inside the printing cylinder 10, feed out through an opening in the printing cylinder 10, around the printing cylinder 10, back through the opening and onto a take up roll for used plate material. In this way a fresh printing plate can be supplied for each print job by simply advancing the supply and take up rolls. The surface 15 including silica, alumina, and a polymeric amine may also contain a quaternary ammonium polymer, and a hardening agent such as formaldehyde. The mixture may also include a mineral acid such as sulfuric or phosphoric acid to neutralize and solubilize the polymeric amine. The mixture may also contain surfactants to improve spreading and uniformity of the coating. Other materials may be added to the mixture for cosmetic purposes, such as colorants of various kinds such as dyes or pigments.

In a preferred embodiment of the invention, the surface 15 is coated from the following aqueous mixture:

5.1% fumed alumina (DeGussa Oxide C)

5.9% colloidal silica (DuPont Ludox CL)

1.17% polyethylenimine (BASF Luprisol SK)

0.25% Poly[bis(2-chloroethyl)ether-alt-1,3-bis[3-(dimethylamino)propyl]urea], quaternized solution (Aldrich Chemical Company, # 45,862-7)

0.46% phosphoric acid 0.01% formaldehyde 0.005% Olin 10G surfactant

Coating the mixture onto the printing cylinder or printing plate support 10 is conveniently done with a wire wound rod, as is well known to those skilled in the art. Other methods of coating can also be used, including extrusion hopper coating, roller coating and spray coating.

The amount of silica in the coating mixture may vary from about 2 percent to about 15 percent, more preferably from about 5 percent to about 7 percent. The amount of alumina in the coating mixture may vary from about 1 percent to about 15 percent, more preferably from about 4 percent to about 6 percent. The amount of polymeric amine in the coating mixture may vary from about 0.1 percent to about 2 percent, more preferably from about 0.7 percent to about 1.4 percent. The kind of silica used in the coating mixture is preferably one that is compatible with a polymeric amine. It has been found that acidic colloidal silica, such as Ludox CL from the DuPont Company, Wilmington, Del., is compatible with polymeric amines. The polymeric amine may be a linear or branched polymer where the amine is part of the polymer backbone chain, such as polyethyleneimine, or can be a polymer where the amine is an appendage from the polymer backbone, such as polyvinybenzylamine or polyallylamine. Most preferably, the amine is a primary or secondary amine. Least preferred are aromatic amines. The polymeric amine may be neutralized with an equivalent amount of mineral acid such as hydrochloric or sulfuric acid before being mixed with the colloidal silica. The alumina used in the coating mixture is preferably a fine particle alumina such as DeGussa Oxide-C fumed alumina. The hardener, if used, is added to the mixture in an amount equal to about 1% to about 3% of the polymeric amine. Coating surfactants are used in amount equal to about 0.001% to about 1% of the total weight of the solution. The wet thickness of the coated layer may vary from about 1 micron to about 100 microns, more preferably from about 10 microns to 40 microns. The coating is air dried, with or without warming, to give the surface 15.

Figure 2:
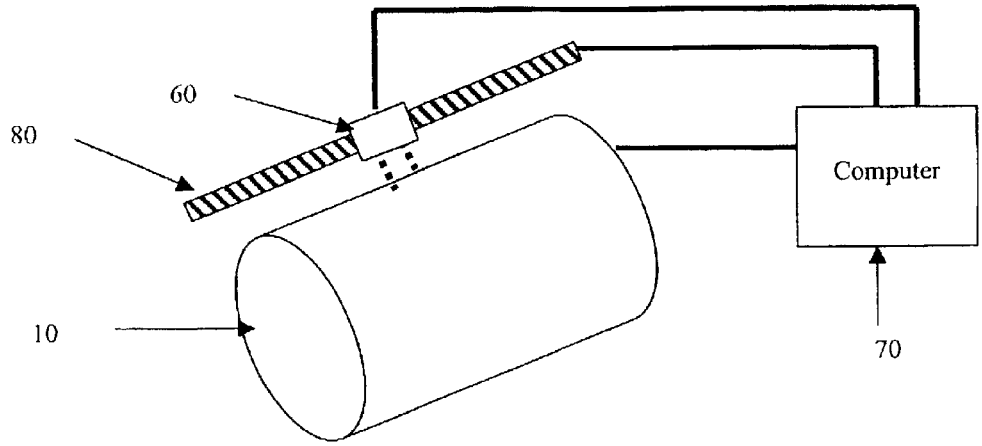
FIG. 2 shows the digital inkjet image being applied to the printing cylinder of the press.

FIG. 2 shows one embodiment using inkjet printing for the imaging of the lithographic printing press. An inkjet print head 60 controlled by a computer 70 is moved across the face of the printing cylinder 10 by a lead screw 80, which is also controlled by the computer 70. Meanwhile, the printing cylinder 10 turns so that each point on the printing surface is addressed by the inkjet printhead 60. As the drops of inkjet fluid, which are shown as black dots in the figure, encounter the plate, the drops are adsorbed into the surface 15, and dry to form an image pixel that is attractive to lithographic printing ink, while the background areas hold water or fountain solution on the printing press and repel lithographic printing ink. It has been found that all the commercial pigment based inkjet inks that we have tried will form an image that will attract or accept lithographic printing ink on a press. In contrast, the commonly used dye based inkjet inks will not form an image that will attract or accept lithographic printing ink on a press. Pigment based inkjet inks are commonly made by grinding a pigment in water with a polymeric dispersing agent, as is well known to those skilled in the art. Further, it has been found that a solution of a polymeric dispersing agent, without added pigment, will also function in this invention to form an image that will attract or accept lithographic printing ink on a press. It appears that the polymeric dispersing agent is the active material in forming an image on the printing plate of this invention, and that the pigment is less important in attracting and holding lithographic ink in the printing process. Nonetheless, the pigment serves a valuable function in this invention, because it makes the image visible, so that the press operator can judge the quality and position of the image before starting the lithographic printing process. The pigment may also contribute somewhat to the ability of the imaged areas of the plate to hold lithographic ink.

The following example will illustrate the practice of the invention.

EXAMPLE 50 g of fumed alumina (DeGussa Oxide C) was mixed with 655 g of water by shaking. Then 193 g of Ludox CL (DuPont) was added and mixed. Then 23 g of Lupasol SK (24% polyethylenimine, from BASF) and 23 g of 2M phosphoric acid were added to the alumina-silica mixture. Then 10 g of 15% Poly[bis(2-chloroethyl)ether-alt-1,3-bis[3-(dimethylamino)propyl]urea], quaternized solution (Aldrich Chemical Company, # 45,862-7) in water was added, and the mixture was tumbled with 1.8 mm zirconia beads for 3 to 7 days. (The tumbling rate starts off slowly, because the mixture was viscous. After 24 hours the tumbling rate can be increased as the viscosity drops.) The mixture was coated on a grained, anodized aluminum support with a 25 micron Meyer Rod and allowed to dry. The plate was then placed in the paper feed tray of an Epson Stylus C80 Inkjet Printer equipped with Epson C80 Durabright Inks. An image was printed onto the plate and allowed to dry. The plate was then mounted on an AB Dick press and 20,000 high quality impressions were made.

The invention has been described in detail, with particular reference to certain preferred embodiments thereof, but it should be understood that variations and modifications can be effected with the spirit and scope of the invention.

PARTS LIST

| | |
|---|---|
| 10 | printing cylinder |
| 15 | surface |
| 20 | ink roller train |
| 25 | ink hopper |
| 30 | dampener roller |
| 35 | fountain solution hopper |
| 40 | blanket cylinder |
| 50 | paper |
| 60 | inkjet print head |
| 70 | computer |
| 80 | lead screw |

What is claimed is:

1. An apparatus for offset lithographic printing comprising:

(a) an offset lithographic printing press including a printing cylinder having a surface including a mixture of cationic colloidal silica, fumed alumina, and a polymeric amine; and (b) an inkjet printhead disposed to print a digital image on the printing cylinder with an inkjet fluid comprising a pigment and a polymeric dispersing agent, which inkjet fluid dries to produce a surface attractive to oleophilic lithographic printing inks.

2. The apparatus of claim 1 wherein the inkjet fluid is a waterbased pigmented ink.

3. The apparatus of claim 1 wherein the surface of the printing cylinder further includes a quaternary ammonium polymer.

4. The apparatus of claim 3 wherein the quaternary ammonium polymer is poly[bis(2-chloroethyl)ether-alt-1,3-bis[3-(dimethylamino)propyl]urea], quaternized.

5. The apparatus of claim 3 wherein the surface of the printing cylinder further includes a hardening agent.

6. The apparatus of claim 5 wherein the hardening agent is formaldehyde.

7. The apparatus of claim 3 wherein the surface of the printing cylinder further includes a mineral acid.

8. The apparatus of claim 1 wherein the surface of the printing cylinder includes polyethylenimine as the polymeric amine, poly[bis(2-chloroethyl)ether-alt-1,3-bis[3-(dimethylamino)propyl]urea], quaternized, sulfuric acid or phosphoric acid, and formaldehyde.

* * * * *